US007456576B2

(12) United States Patent
Emori et al.

(10) Patent No.: US 7,456,576 B2
(45) Date of Patent: Nov. 25, 2008

(54) DISCHARGE TUBE

(75) Inventors: Chisato Emori, Nagano (JP); Kesayuki Takeuchi, Nagano (JP); Kazuhiko Machida, Nagano (JP)

(73) Assignee: Shinko Electric Industries Co., Ltd., Nagano-shi (JP)

( * ) Notice: Subject to any disclaimer, the term of this patent is extended or adjusted under 35 U.S.C. 154(b) by 36 days.

(21) Appl. No.: 11/351,668

(22) Filed: Feb. 10, 2006

(65) Prior Publication Data

US 2006/0181219 A1 Aug. 17, 2006

(30) Foreign Application Priority Data

Feb. 15, 2005 (JP) ..... 2005-038012

(51) Int. Cl.
*H01J 61/35* (2006.01)

(52) U.S. Cl. ..... 313/635; 313/634; 313/493

(58) Field of Classification Search ..... 313/635, 313/634, 489, 493, 636
See application file for complete search history.

(56) References Cited

U.S. PATENT DOCUMENTS 4,538,202 A 8/1985 Ferguson
5,394,050 A * 2/1995 Aoyama ..... 313/112
2004/0150346 A1 8/2004 Machida
2006/0017366 A1 * 1/2006 Hendriks et al. ..... 313/489

FOREIGN PATENT DOCUMENTS

| | | |
|---|---|---|
| EP | 0602927 | 6/1994 |
| JP | 3-283335 | 12/1991 |
| JP | 3-283336 | 12/1991 |
| JP | 9-63742 | 3/1997 |
| JP | 2004-220808 | * 8/2004 |
| JP | 2004-235017 | 8/2004 |

* cited by examiner

*Primary Examiner*—Bao Q Truong
(74) *Attorney, Agent, or Firm*—Rankin, Hill & Clark LLP

(57) ABSTRACT

A discharge tube comprises a pair of discharge electrodes opposed to each other with a discharge space in-between, an airtight cylinder in which the discharge space is formed, the pair of the electrodes respectively being mounted on both ends of the airtight cylinder, and a coating film which is resistant to water permeation, and formed on a surface of the airtight cylinder. With the discharge tube, it is possible to perform a stable discharge having a good insulating property between the discharge electrodes even when the external environment changes.

2 Claims, 5 Drawing Sheets

FIG. 3

| | RELATED ART ARTICLE | | | COATED ARTICLE A | | | COATED ARTICLE B | |
|---|---|---|---|---|---|---|---|---|
| No. | AT NORMAL TEMPERATURE AND UNDER NORMAL HUMIDITY | AT HIGH TEMPERATURE AND UNDER HIGH HUMIDITY | | AT NORMAL TEMPERATURE AND UNDER NORMAL HUMIDITY | AT HIGH TEMPERATURE AND UNDER HIGH HUMIDITY | | AT NORMAL TEMPERATURE AND UNDER NORMAL HUMIDITY | AT HIGH TEMPERATURE AND UNDER HIGH HUMIDITY |
| 1 | 1,00,000 | 100 | | 1,00,000 | 10,000 | | 1,00,000 | 20,000 |
| 2 | 1,00,000 | 20 | | 1,00,000 | 10,000 | | 1,00,000 | 10,000 |
| 3 | 1,00,000 | 20 | | 1,00,000 | 20,000 | | 1,00,000 | 50,000 |
| 4 | 1,00,000 | 5 | | 1,00,000 | 10,000 | | 1,00,000 | 100,000 |
| 5 | 1,00,000 | 100 | | 1,00,000 | 20,000 | | 1,00,000 | 50,000 |
| 6 | 1,00,000 | 50 | | 1,00,000 | 50,000 | | 1,00,000 | 20,000 |
| 7 | 1,00,000 | 10 | | 1,00,000 | 100,000 | | 1,00,000 | 200,000 |
| 8 | 1,00,000 | 50 | | 1,00,000 | 20,000 | | 1,00,000 | 10,000 |
| 9 | 1,00,000 | 50 | | 1,00,000 | 30,000 | | 1,00,000 | 50,000 |
| 10 | 1,00,000 | 100 | | 1,00,000 | 30,000 | | 1,00,000 | 20,000 |
| 11 | 1,00,000 | 50 | | 1,00,000 | 100,000 | | 1,00,000 | 200,000 |
| 12 | 1,00,000 | 20 | | 1,00,000 | 50,000 | | 1,00,000 | 50,000 |
| 13 | 1,00,000 | 20 | | 1,00,000 | 30,000 | | 1,00,000 | 50,000 |
| 14 | 1,00,000 | 100 | | 1,00,000 | 20,000 | | 1,00,000 | 100,000 |
| 15 | 1,00,000 | 50 | | 1,00,000 | 100,000 | | 1,00,000 | 50,000 |
| 16 | 1,00,000 | 50 | | 1,00,000 | 50,000 | | 1,00,000 | 20,000 |
| 17 | 1,00,000 | 100 | | 1,00,000 | 50,000 | | 1,00,000 | 20,000 |
| 18 | 1,00,000 | 100 | | 1,00,000 | 10,000 | | 1,00,000 | 20,000 |
| 19 | 1,00,000 | 50 | | 1,00,000 | 50,000 | | 1,00,000 | 20,000 |
| 20 | 1,00,000 | 100 | | 1,00,000 | 50,000 | | 1,00,000 | 100,000 |
| MAX. | 1,00,000 | 100 | | 1,00,000 | 100,000 | | 1,00,000 | 200,000 |
| AVE. | 1,00,000 | 57 | | 1,00,000 | 40,500 | | 1,00,000 | 58,000 |
| MIN. | 1,00,000 | 5 | | 1,00,000 | 10,000 | | 1,00,000 | 10,000 |

FIG. 4

| | RELATED ART ARTICLE (AT NORMAL TEMPERATURE AND UNDER NORMAL HUMIDITY) | | | RELATED ART ARTICLE (AT HIGH TEMPERATURE AND UNDER HIGH HUMIDITY) | | |
|---|---|---|---|---|---|---|
| No. | IR | FVS | Vsdc | IR | FVS | Vsdc |
| 1 | 1,00,000 | 872 | 852 | 10 | 640 | 600 |
| 2 | 1,00,000 | 860 | 852 | 20 | 532 | 544 |
| 3 | 1,00,000 | 896 | 876 | 10 | 608 | 596 |
| 4 | 1,00,000 | 872 | 876 | 50 | 588 | 572 |
| 5 | 1,00,000 | 876 | 864 | 100 | 680 | 684 |
| 6 | 1,00,000 | 876 | 888 | 20 | 604 | 586 |
| 7 | 1,00,000 | 866 | 860 | 20 | 540 | 540 |
| 8 | 1,00,000 | 896 | 876 | 50 | 652 | 648 |
| 9 | 1,00,000 | 884 | 884 | 10 | 520 | 540 |
| 10 | 1,00,000 | 884 | 864 | 20 | 488 | 492 |
| | (UNIT: MΩ ) | | (UNIT: V) | (UNIT: MΩ) | | (UNIT: V) |
| | COATED ARTICLE (AT NORMAL TEMPERATURE AND UNDER NORMAL HUMIDITY) | | | COATED ARTICLE (AT HIGH TEMPERATURE AND UNDER HIGH HUMIDITY) | | |
| No. | IR | FVS | Vsdc | IR | FVS | Vsdc |
| 1 | 1,00,000 | 828 | 808 | 50,000 | 828 | 824 |
| 2 | 1,00,000 | 880 | 868 | 20,000 | 880 | 876 |
| 3 | 1,00,000 | 860 | 844 | 20,000 | 860 | 852 |
| 4 | 1,00,000 | 884 | 896 | 50,000 | 876 | 880 |
| 5 | 1,00,000 | 868 | 872 | 20,000 | 880 | 872 |
| 6 | 1,00,000 | 860 | 848 | 50,000 | 848 | 840 |
| 7 | 1,00,000 | 836 | 836 | 20,000 | 828 | 828 |
| 8 | 1,00,000 | 836 | 828 | 100,000 | 832 | 836 |
| 9 | 1,00,000 | 876 | 868 | 50,000 | 868 | 872 |
| 10 | 1,00,000 | 852 | 848 | 20,000 | 848 | 848 |

DISCHARGE TUBE

This application claims foreign priority based on Japanese Patent application No. 2005-038012, filed Feb. 15, 2005, the contents of which is incorporated herein by reference in its entirety.

BACKGROUND OF THE INVENTION

1. Field of the Invention

The present invention relates to a discharge tube having a pair of discharge electrodes.

2. Description of the Related Art

In order to generate a discharge phenomenon in a space, it is necessary to apply a voltage exceeding a discharge starting voltage to the space. For this purpose, a circuit for generating a high-voltage trigger may be required. For example, an HID (High Intensity Discharge) recently used for a vehicle headlight and the like requires an ignition circuit for generating a high-voltage trigger used to start discharge. The ignition circuit is mainly configured with a capacitor for storing charge, a transformer for generating the high-voltage trigger, and a discharge tube (sometimes referred to as a switching discharge tube) for generating a stable power supply pulse (for example, refer to JP-A-2004-220808 and JP-A-2004-235017).

FIGS. 6 and 7 show a discharge tube 100 as an exemplary discharge tube used in the related art. FIG. 6 is a cross-sectional view of the discharge tube 100, and FIG. 7 is a perspective view showing an external appearance of the discharge tube 100.

Referring to FIGS. 6 and 7, the discharge tube 100 is roughly configured with an airtight cylinder 110, an upper discharge electrode 122, a lower discharge electrode 124, filler gas, and the like. The airtight cylinder 110 in which a discharge space 100*a* is formed has a cylindrical shape, and is formed of an insulating material such as a ceramic material.

An upper discharge electrode 122 and a lower discharge electrode 124 are attached at a top end opening and a bottom end opening of the airtight cylinder 110 respectively. The upper discharge electrode 122 and the lower discharge electrode 124 are integrally formed with a disc-shaped cap portion 126 and a disc-shaped cap portion 128, respectively.

A metalized face 140 is formed at the top end opening and the bottom end opening of the airtight cylinder 110. The cap portions 126 and 128 formed at the upper discharge electrode 122 and the lower discharge electrode 124 are brazed to the metalized face 140 formed at each opening of the airtight cylinder 110. Thus, the upper discharge electrode 122 and the lower discharge electrode 124 are attached to the airtight cylinder 110. When they are attached together, filler gas is sealed in the airtight cylinder 110. In this way, the discharge space 100*a* where the filler gas is sealed is formed in the airtight cylinder 110 by the airtight cylinder 110, the upper discharge electrode 122 and the lower discharge electrode 124.

The upper discharge electrode 122 protrudes from the cap portion 126 toward a center position of the airtight cylinder 110, and its tip portion is formed in a cylindrical shape having small diameter. An upper discharge electrode face 123 is formed at the tip portion of the cylindrical shape having small diameter, and a concave portion 127 is formed on the upper discharge electrode face 123 for generating a stable discharge.

Similarly, the lower discharge electrode 124 protrudes from the cap portion 128 toward the center position of the airtight cylinder 110, and its tip portion is formed in a cylindrical shape having small diameter. A lower discharge electrode face 125 is formed at the tip portion of the cylindrical shape having small diameter, and a concave portion 127 is also formed on the lower discharge electrode face 125 for generating a stable discharge. On the upper discharge electrode face 123 and the lower discharge electrode face 125 is applied copper plating, for example.

Discharge of the discharge tube 100 is generated at a discharge gap 129 as a separated portion between the upper discharge electrode face 123 and the lower discharge electrode face 125 in the discharge space 100*a*.

Lead wires 112, 114 are respectively connected to the upper discharge electrode 122 and the lower discharge electrode 124 for easy connection of the discharge tube 100 with another device.

Furthermore, a variety of materials may be used for a discharge tube. In addition to the structure described above, a discharge tube made of glass is proposed, for example. In this case, coating for breakage prevention is applied to a surface of the glass so as to prevent possible breakage of glass when the glass is mounted on a board by an insert machine (for example, refer to JP-A-9-63742).

In many cases, discharge tube has been used in a device placed indoors where environmental condition around the discharge tube does not change largely. However, recently, environments in which the discharge tube is used are not limited to certain conditions but may be diverse such as the discharge tube used for a vehicle headlight. A predetermined electrical characteristic may not be obtained under harsh conditions.

For example, in a case where the discharge tube is used under a condition of high temperature and high humidity, moisture may adhere to the airtight cylinder shown in FIGS. 6 and 7, thus deteriorating an insulation resistance and an electrical characteristic (switching characteristic) of the airtight cylinder. Moreover, in case where a sudden change occurs in an external temperature, the airtight cylinder may produce dew condensation and the adhered moisture may deteriorate the insulation resistance.

SUMMARY OF THE INVENTION

An object of the invention is to provide a novel and useful discharge tube that has solved the above problems.

In some implementations, the present invention provides a discharge tube capable of performing a stable discharge having a good insulating property between discharge electrodes even when the external environment changes.

According to an aspect of the invention, a discharge tube comprises: a pair of electrodes opposed to each other with a discharge space in-between; an airtight cylinder in which the discharge space is formed, the pair of the electrodes respectively being mounted on both ends of the airtight cylinder; and a coating film which is resistant to water permeation, and formed on a surface of the airtight cylinder.

The discharge tube is capable of performing a stable discharge having a good insulating property between the electrodes performing the discharge even when the external environment changes.

It is preferable that in the discharge tube of the present invention, the airtight cylinder is made of an insulating material. Further, it is preferable that in the discharge tube of the present invention, the insulating material is a ceramic material. Thus, a good insulating property between the electrodes is assured.

It is preferable that in the discharge tube of the present invention, the coating film is made of a light transmitting material. Thus, a good discharge characteristic of the discharge tube is assured.

According to the discharge tube of the present invention, it is possible to perform a stable discharge having a good insulating property between the discharge electrodes even when the external environment changes.

BRIEF DESCRIPTION OF THE DRAWINGS

FIG. 3 shows differences in resistance values of discharge tubes having differences in coating.

FIG. 4 shows differences in discharge characteristics of discharge tubes having differences in coating.

DESCRIPTION OF THE PRFERRED EMBODIMENTS

An embodiment of the invention will be described referring to drawings.

First Embodiment

Figure 1:
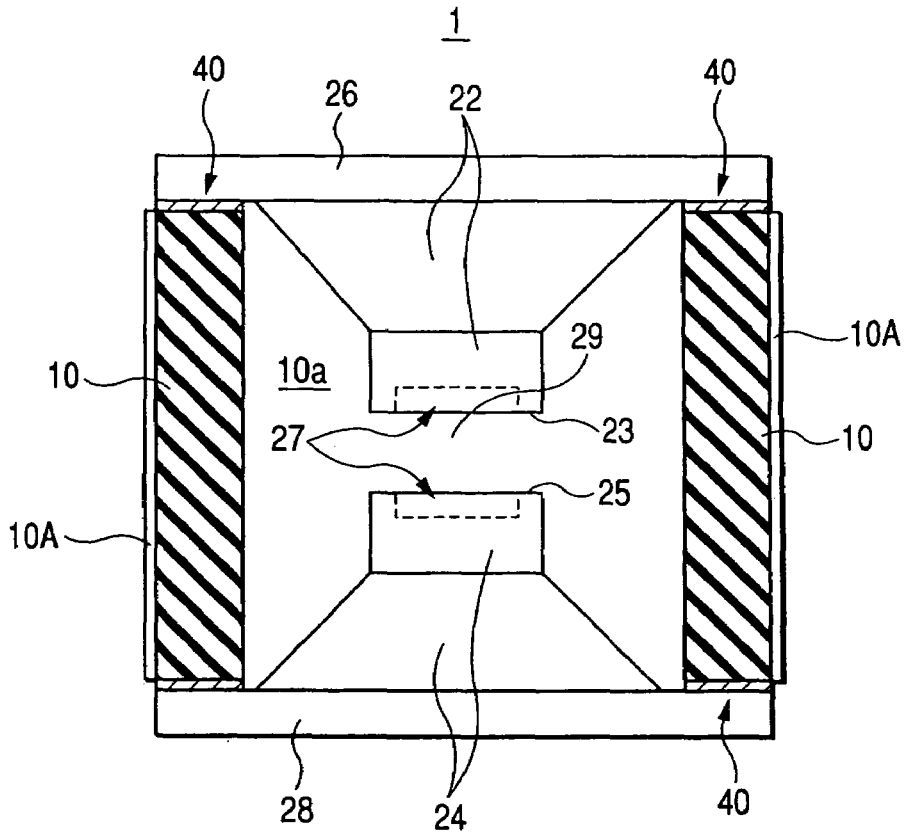
FIG. 1 is a cross-sectional view of a discharge tube according to a first embodiment.
Figure 2:
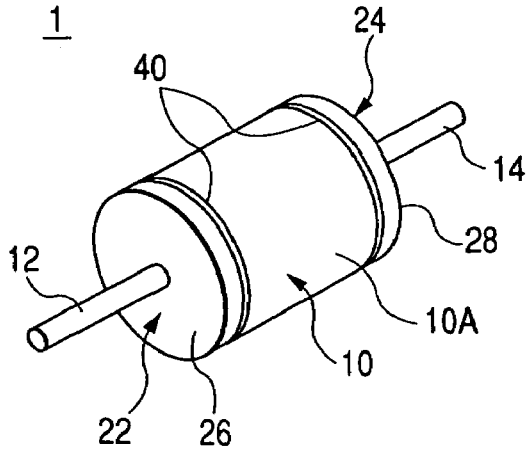
FIG. 2 shows an external appearance of a discharge tube according to a first embodiment.

FIGS. 1 and 2 show a discharge tube 1 as an exemplary discharge tube according to the first embodiment of the invention. FIG. 1 is a cross-sectional view of the discharge tube 1. FIG. 2 is a perspective view showing an external appearance of the discharge tube 1.

Referring to FIGS. 1 and 2, the discharge tube 1 includes an airtight cylinder 10, an upper discharge electrode 22, a lower discharge electrode 24, filler gas, and the like. The airtight cylinder 10 in which a discharge space is formed has a cylindrical shape, and is formed of an insulating material such as a ceramic material.

The upper discharge electrode 22 and the lower discharge electrode 24 are attached at a top end opening and a bottom end opening of the airtight cylinder 10 respectively. The upper discharge electrode 22 and the lower discharge electrode 24 are integrally formed with a disc-shaped cap portion 26 and a disc-shaped cap portion 28, respectively.

A metalized face 40 is formed at the top end opening and the bottom end opening of the airtight cylinder 10. The cap portions 26 and 28 formed at the upper discharge electrode 22 and lower discharge electrode 24 are brazed to the metalized face 40 formed at each opening of the airtight cylinder 10. Thus, the upper discharge electrode 22 and the lower discharge electrode 24 are attached to the airtight cylinder 10. When they are attached together, filler gas is sealed in the airtight cylinder 10. In this way, the discharge space 10*a* where the filler gas is sealed is formed in the airtight cylinder 10 by the airtight cylinder 10, the upper discharge electrode 22 and the lower discharge electrode 24.

The upper discharge electrode 22 protrudes from the cap portion 26 toward a center position of the airtight cylinder 10, and its tip portion is formed in a cylindrical shape having small diameter. An upper discharge electrode face 23 is formed at the tip portion of the cylindrical shape having small diameter, and a concave portion 27 is formed on the upper discharge electrode face 23 for generating a stable discharge.

Similarly, the lower discharge electrode 24 protrudes from the cap portion 28 toward the center position of the airtight cylinder 10, and its tip portion is formed in a cylindrical shape having small diameter. A lower discharge electrode face 25 is formed at the tip portion of the cylindrical shape having small diameter, a concave portion 27 is also formed on the lower discharge electrode face 25 for generating a stable discharge. On the upper discharge electrode face 23 and the lower discharge electrode face 25 is applied copper plating, for example.

Discharge of the discharge tube 1 is generated at a discharge gap 29 as a separated portion between the upper discharge electrode face 23 and the lower discharge electrode face 25 in the discharge space 10*a*.

Lead wires 12, 14 are respectively connected to the upper discharge electrode 22 and the lower discharge electrode 24 for easy connection of the discharge tube 1 with another device.

The discharge tube 1 according to this embodiment uses 42 alloy, Kovar, an iron-nickel-chromium alloy, etc. as a material of the upper and lower discharge electrodes 22, 24. In addition, the copper plating is applied to the upper discharge electrode face 23 and the lower discharge electrode face 25 of the upper and lower discharge electrodes 22, 24. A thickness of the copper plating is desirably about some micrometers to 20 micrometers.

As mentioned above, the airtight cylinder 10 is formed of the insulating material such as ceramic (for example, an alumina ceramic), and the upper discharge electrode 22 and the lower discharge electrode 24 are brazed to the airtight cylinder 10. Thus, by using 42 alloy, Kovar, the iron-nickel-chromium alloy, etc. having a small difference in thermal expansion coefficient from ceramic as the material of the upper discharge electrode 22 and the lower discharge electrode 24, a secure brazing is possible and the reliability of the discharge tube 1 can be enhanced.

However, in the related art, in a case where the discharge tube is used under a condition of high temperature and high humidity, moisture may adhere to a surface of the airtight cylinder 10. Then, the insulating property between the upper discharge electrode 22 and the lower discharge electrode 24 is deteriorated, whereby changing the discharge characteristic of the discharge tube. For example, in a case where the discharge tube is formed of the ceramic material or the like, moisture is likely to adhere to the airtight cylinder 10, causing the deterioration of the insulating property, since the ceramic material has fine unevenness on its surface and is a porous material from a microscopic point of view.

In the discharge tube 1 according to this embodiment, a coating film 10A which is made of an insulating material and is resistant to water permeation is formed on the surface of the airtight cylinder 10, on an opposite side of a side where the discharge is generated, that is, on a side of the airtight cylinder 10 facing the atmosphere. Therefore, good insulating property between the upper discharge electrode 22 and the lower discharge electrode 24 can be achieved, and the stable discharge can be maintained.

For example, forming the coating film 10A on the surface of the airtight cylinder 10 provides an advantage that the coating film 10A permeates the unevenness or fine holes on the surface of the ceramic material, and fills portions where the moisture is likely to adhere, so as to suppress the adhesion of the moisture. Further, the coating film preferably is resistant to water permeation so as to prevent invasion of the moisture.

Thus, when the discharge tube is used in an environment of high temperature and high humidity or in an environment where the temperature changes wildly and dew condensation is likely to occur, deterioration of the insulating property of the airtight cylinder is suppressed, thereby generating a stable discharge.

For example, as a material of the coating film 10A, a silicon material, a fluorine material or a lacquer material (ethyl acetate being its principal material), etc. may be used. Such a coating film may be of various specifications such as being cured at normal temperature (normal temperature curing type), being cured by heat (heat curing type), or being cured by ultraviolet irradiation (UV curing type), after the material for coating is applied to the surface of the airtight cylinder 10, for example.

The coating film 10A is preferably made of a light transmitting material. The reason is described below. When light stops entering the discharge space 10*a*, photoelectrons are not generated in the discharge space, which disturbs the generation of discharge due to the change in the discharge state. By forming the coating film 10A with the light transmitting material, stable discharge is generated in the discharge space 10A, thus eliminating the influence of the interception of light. Moreover, it is further possible to read product management information such as a serial number printed on the airtight cylinder 10, for example, thus facilitating management of a product.

In this case, the coating film 10A preferably transmits substantially equal to or more than 50 percent of light in the visible light range for the stable discharge. In this embodiment, the light transmitting material transmits substantially equal to or more than 50 percent of light in the visible light range.

In this case, the thickness of the coating film 10A is preferably substantially equal to or more than 1 micrometer. This is because such a thickness is preferable to fill the unevenness on the surface of the ceramic material and maintain a sufficient insulating property. On the other hand, the thickness of the coating film 10A is preferably substantially equal to or less than 500 micrometers. This is because in this case, a thicker coating film does not contribute to the stable discharge.

Next, a result of a measurement of an electric resistance of the discharge cylinder 10 of the discharge tube 1 according to the embodiment is shown in FIG. 3. FIG. 3 shows an example of a case where a coated article A using a fluorine material as the material of the coating film 10A, and an example of a case where a coated article B using a lacquer material as the material of the coating film 10A. For comparison, an electric resistance obtained when no coating is applied to a discharge cylinder is given as a related art article.

In the experiment, 20 samples are prepared for each case and resistance values are measured for the 20 samples. Moreover, for each case, the measurement is performed in a condition where the outside air is at normal temperature and under normal humidity (temperature: 26° C.; humidity: 42%), and a condition where the outside air is at high temperature and under high humidity (temperature: 40° C.; humidity: 90%), and the results are compared with each other. Here, a unit of the resistance value in the figure is "megohm", and an upper limit measurement value of a measuring instrument is 1000000 megohm.

Referring to FIG. 3, the measurement result of the related art article to which no coating is applied shows a considerable drop in the resistance value concerning the average value of the 20 samples, since the resistance value obtained at high temperature and under high humidity is about 0.057 percent of that obtained at normal temperature and under normal humidity.

On the other hand, in the measurement results of the coated article A and the coated article B, although the resistance value decreases in the condition of high temperature and high humidity compared to the condition of normal temperature and normal humidity, the rate of the decrease in the resistance value is suppressed as compared to the related art article. For example, in the case of the coated article A, concerning the average value of the 20 samples, the resistance value obtained at high temperature and under high humidity is about 710 times as large as that of the related art article. Furthermore, in the case of the coated article B, concerning the average value of the 20 samples, the resistance value obtained at high temperature and under high humidity is about 1018 times as large as that of the related art article.

FIG. 4 shows a result of comparison of discharge characteristics obtained by applying voltage between electrodes and successively generating discharge between the electrodes in the cases of the related art article and the coated article B. In the figure, IR represents a resistance value, FVs represents the voltage at a first discharge, and Vsdc represents the voltage at a second discharge. Experiment is conducted for 10 samples of discharge tubes respectively in the cases of the related art article and the coated article B, in a case of normal temperature and normal humidity and a case of high temperature and high humidity.

Referring to FIG. 4, in the case of the related art article, the resistance value considerably drops in the case of high temperature and high humidity compared to the case of normal temperature and normal humidity, as mentioned earlier. Also, both the first discharge voltage and the second discharge voltage are decreased.

For example, taking the first discharge voltage as an example, the voltage obtained at normal temperature and under normal humidity is 860V to 896V while the voltage obtained at high temperature and under high humidity is as low as 488V to 680V. The second discharge shows a similar tendency.

On the other hand, in the case of the coated article, both the first discharge voltage and the second discharge voltage are slightly decreased in the case of high temperature and high humidity compared to the case of normal temperature and normal humidity. This shows that the change in the discharge characteristic associated with the change of environment where the discharge tube is used is suppressed.

For example, taking the first discharge voltage as an example, the voltage obtained at normal temperature and under normal humidity is 828V to 884V while the voltage obtained at high temperature and under high humidity is 828V to 880V, which shows that substantially the same voltage is maintained. The second discharge shows a similar tendency.

This may be because the deterioration of the insulating property of the airtight cylinder is suppressed by applying the coating on the surface of the airtight cylinder, and in particular, the decrease of the resistance value in the case of high temperature and high humidity, and the associated change in the discharge characteristic (switching characteristic) are suppressed.

Figure 5A:
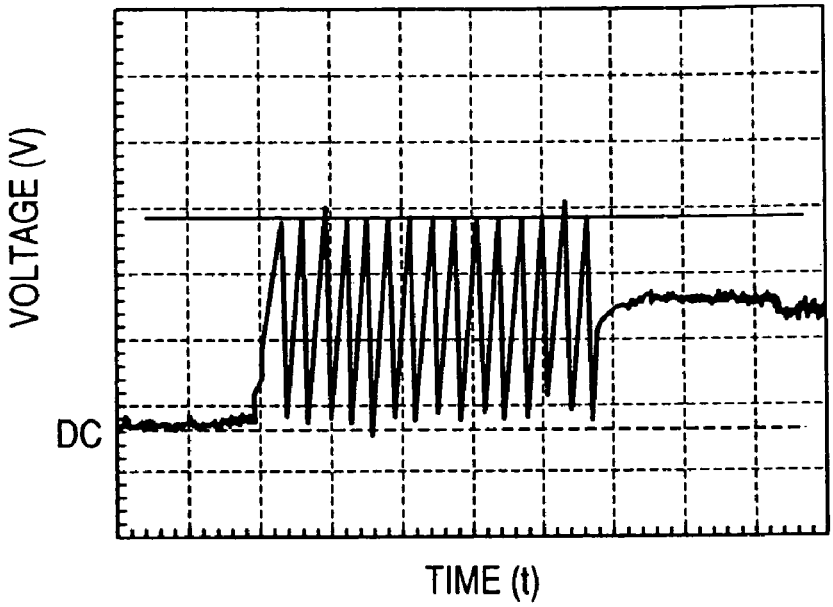
FIG. 5A shows a state of a voltage obtained when successive discharge is performed with a discharge tube.
Figure 5B:
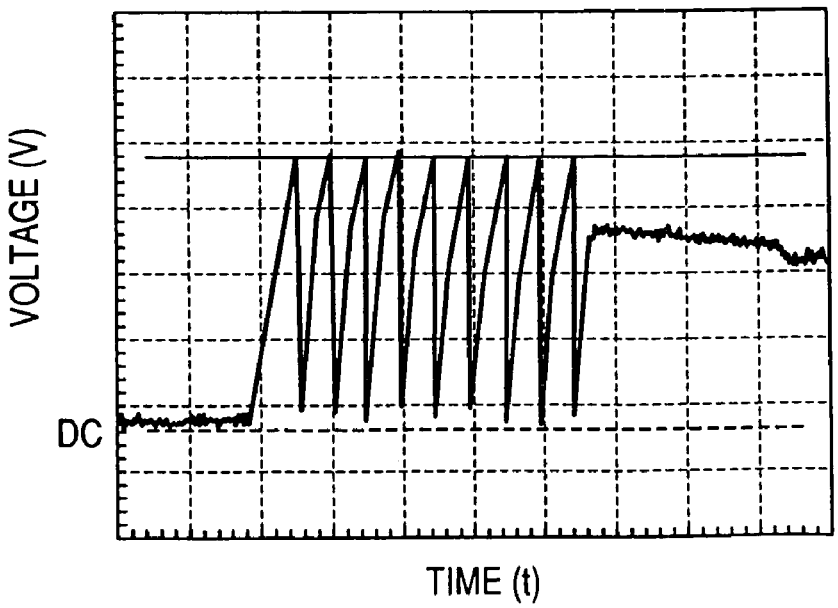
FIG. 5B shows a state of a voltage obtained when successive discharge is performed with a discharge tube.
Figure 6:
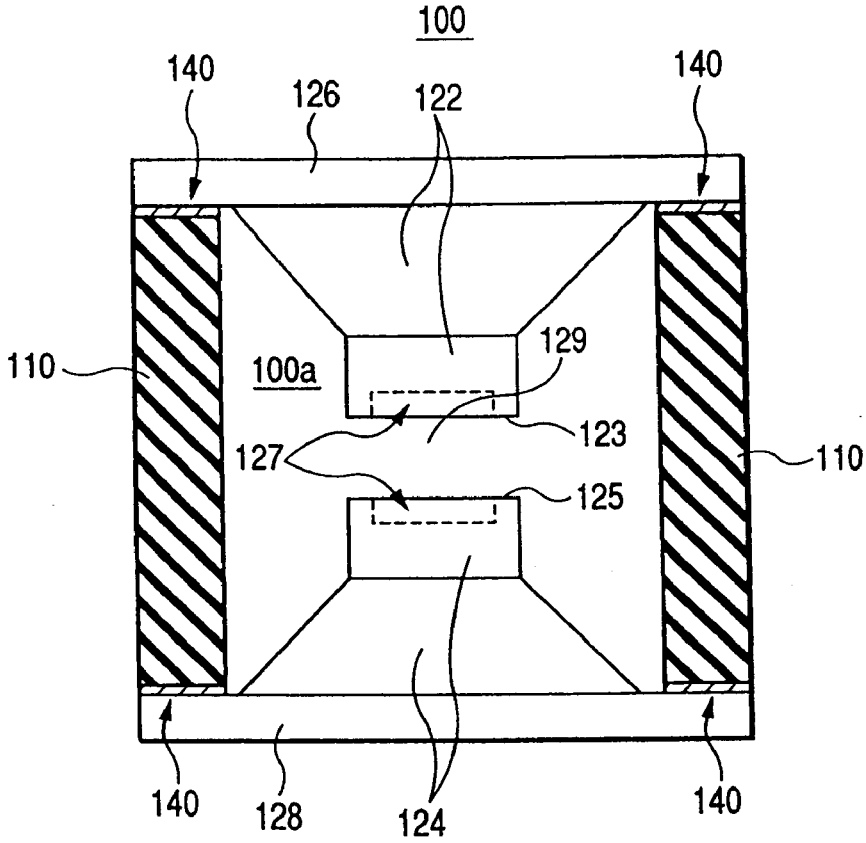
FIG. 6 (PRIOR ART)
FIG. 6 is a cross-sectional view of a discharge tube used in the prior art.
Figure 7:
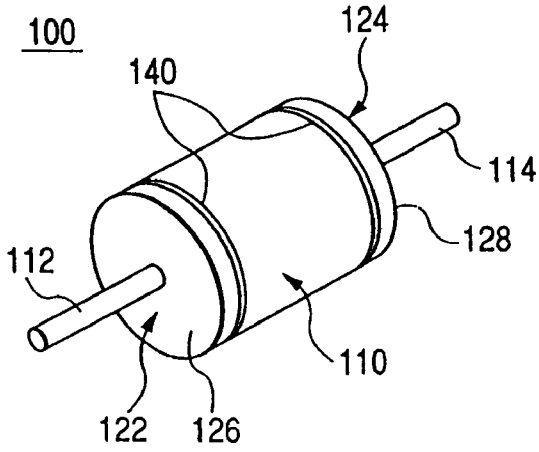
FIG. 7 (PRIOR ART)
FIG. 7 shows an external appearance of a discharge tube used in the prior art.

Next, FIGS. 5A and 5B show a state of a voltage obtained in a case where successive discharge is performed in the case of high temperature and high humidity shown in FIG. 4 with respect to the related art article and the coated article (the coated article B). FIG. 5A shows the case of the related article, and FIG. 5B shows the case of the coated article. Here, a single cell represents 200V on the vertical axis, and 25 ms on the horizontal axis.

Referring to FIGS. 5A and 5B, the discharge voltage is about 640 mV in the case of the related art article shown in FIG. 5A, while it is about 840V in the case of the coated article shown in FIG. 5B. This shows that the discharge voltage is maintained high in the case of the coated article.

In this way, stable discharge is successively available in an environment such as of high temperature and high humidity. Thus, the discharge tube according to this embodiment provides an advantage that the discharge characteristic is more stable than the related art article, when mounted on a vehicle that is subjected to changes in the surrounding environment, for example.

For this reason, the discharge tube according to this embodiment is preferably used as a discharge tube (sometimes referred to as a switching discharge tube) for generating a power supply pulse in an ignition circuit in an HID or the like for generating a high-voltage trigger used to start discharge.

The discharge tube according to this embodiment is not limited to the above case but may be used in a circuit used to illuminate a backlight of a projector and a variety of other circuits.

While the invention has been described with respect to a preferred embodiment, the invention is not limited to the specific embodiment but various changes and modifications can be made in it without departing from the claims.

According to the invention, it is possible to perform a stable discharge having a good insulating property between discharge electrodes even when the external environment changes.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

What is claimed is:

1. A discharge tube comprising:

first and second electrodes opposed to each other with a discharge space in-between;

an airtight cylinder made of an insulating material, wherein said insulating material is a ceramic material, in which the discharge space is formed, said cylinder having first and second ends and a cylindrical sidewall, said first electrode being mounted in said first end of the cylinder, and said second electrode being mounted in said second end of the cylinder, wherein said first and second electrodes are mounted in respective first and second ends of the cylinder so as to seal said first and second ends of the cylinder in an airtight manner; and a coating film which is resistant to water permeation, said coating film being formed directly on an outside surface of the sidewall of the airtight cylinder opposite a surface of the airtight cylinder facing the discharge space, wherein the coating film is an insulating material and a light transmitting material, wherein the coating film transmits at least 50 percent of light in a visible light range, and wherein the discharge tube is a switching discharge tube.

2. The discharge tube according to claim 1, wherein the coating film has a thickness between 1 μm and 500 μm.

* * * * *